US011725566B2

(12) United States Patent
Sato et al.

(10) Patent No.: US 11,725,566 B2
(45) Date of Patent: Aug. 15, 2023

(54) EXHAUST STRUCTURE

(71) Applicant: Honda Motor Co., Ltd., Tokyo (JP)

(72) Inventors: Kiyotaka Sato, Tokyo (JP); Hidenori Suzuki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/952,299

(22) Filed: Sep. 25, 2022

(65) Prior Publication Data

US 2023/0103188 A1 Mar. 30, 2023

(30) Foreign Application Priority Data

Sep. 28, 2021 (CN) ..... 202122361527.5

(51) Int. Cl.
*F01N 13/08* (2010.01)
*F01N 13/00* (2010.01)

(52) U.S. Cl.
CPC ..... *F01N 13/082* (2013.01); *F01N 13/007* (2013.01); *F01N 2340/04* (2013.01); *F01N 2470/00* (2013.01)

(58) Field of Classification Search
CPC .. F01N 13/007; F01N 13/082; F01N 2340/04; F01N 2470/00
USPC ..... 60/323
See application file for complete search history.

(56) References Cited

U.S. PATENT DOCUMENTS 8,793,985 B2 * 8/2014 Nakamura ..... F01N 3/055 60/287
2010/0032227 A1 * 2/2010 Oguri ..... F01N 1/00 181/227

FOREIGN PATENT DOCUMENTS

JP 3900239 4/2007

* cited by examiner

*Primary Examiner* — Jorge L Leon, Jr.
(74) *Attorney, Agent, or Firm* — JCIPRNET

(57) ABSTRACT

The utility model provides an exhaust structure having a lightweight structure. The utility model provides an exhaust structure, comprising: an exhaust pipe; and a muffler connected to the exhaust pipe. The exhaust pipe includes an upstream side opening portion, a downstream side opening portion, and a winding portion. The winding portion is formed by winding pipings between the upstream side opening portion and the downstream side opening portion. The muffler is connected to the upstream side opening portion of the exhaust pipe, and the winding portion overlaps the muffler in a front-rear direction.

6 Claims, 2 Drawing Sheets

EXHAUST STRUCTURE

CROSS-REFERENCE TO RELATED APPLICATION

This application claims the priority benefits of China application no. 202122361527.5, filed on Sep. 28, 2021. The entirety of the above-mentioned patent application is hereby incorporated by reference herein and made a part of this specification.

BACKGROUND

Technical Field

The utility model relates to an exhaust structure.

Related Art

In recent years, in order to suppress natural disasters, from the viewpoint of improving the global environment, it is necessary to improve the fuel efficiency of automobiles, and regulatory restrictions related to automobile exhaust emissions are becoming more and more advanced. On the other hand, there is a need to maintain or improve the crash safety of vehicles. To meet these needs, the development of high-strength and lightweight body structures is underway.

Patent Literature 1 discloses an exhaust structure. In the case where the length of the exhaust pipe needs to be increased, the water splashed by the tire tends to hit the exhaust pipe directly, such the heated exhaust pipe may be deformed by the sudden temperature change caused by the water. Therefore, it is necessary to provide a cover to prevent water splashes. However, this increases the cost and weight of the body structure.

CITATION LIST

Patent Literature

[Patent Literature 1] Japanese Patent No. 3900239

The utility model provides an exhaust structure that is capable of preventing water from the front from splashing on the exhaust pipe, and has a lightweight structure.

SUMMARY

The utility model provides an exhaust structure, which includes: an exhaust pipe; and a muffler connected to the exhaust pipe. The exhaust pipe includes an upstream side opening portion, a downstream side opening portion, and a winding portion. The winding portion is formed by winding pipings between the upstream side opening portion and the downstream side opening portion. The muffler is connected to the upstream side opening portion of the exhaust pipe. The winding portion overlaps the muffler in a front-rear direction.

BRIEF DESCRIPTION OF THE DRAWINGS

In order to make the above-mentioned features and advantages of the utility model more obvious and easy to understand, the following examples are given and described in detail in conjunction with the accompanying drawings as follows.

DESCRIPTION OF THE EMBODIMENTS

Figure 1:
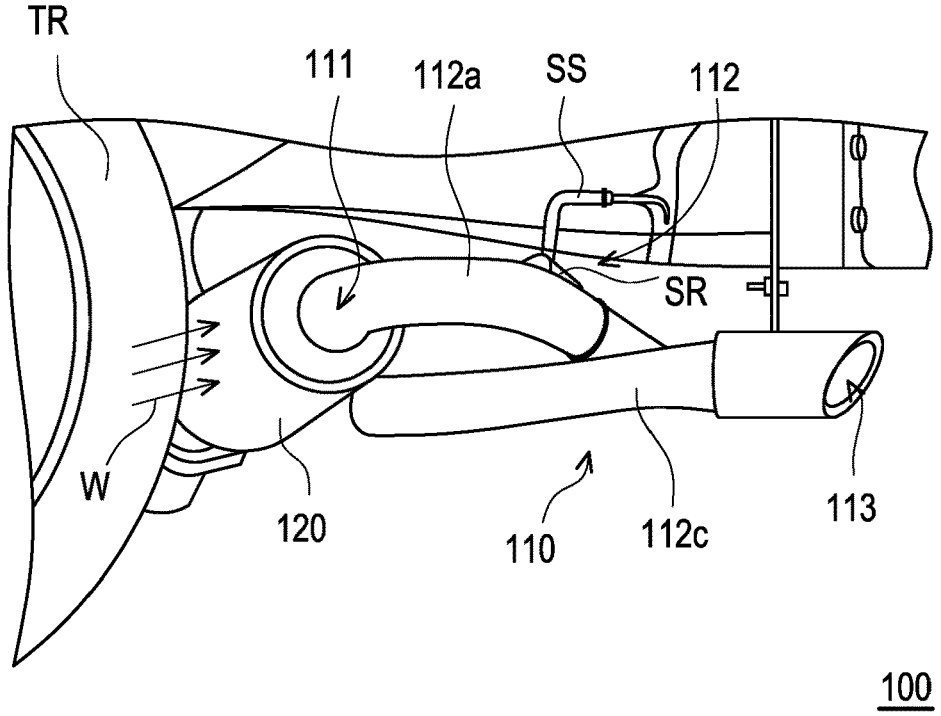
FIG. 1 is a schematic side view of an exhaust structure according to an embodiment of a utility model.

Reference will now be made in detail to the exemplary embodiments of the disclosure, examples of which are illustrated in the accompanying drawings. Wherever possible, the same reference numbers are used in the drawings and the description to refer to the same or like parts.

Figure 2:
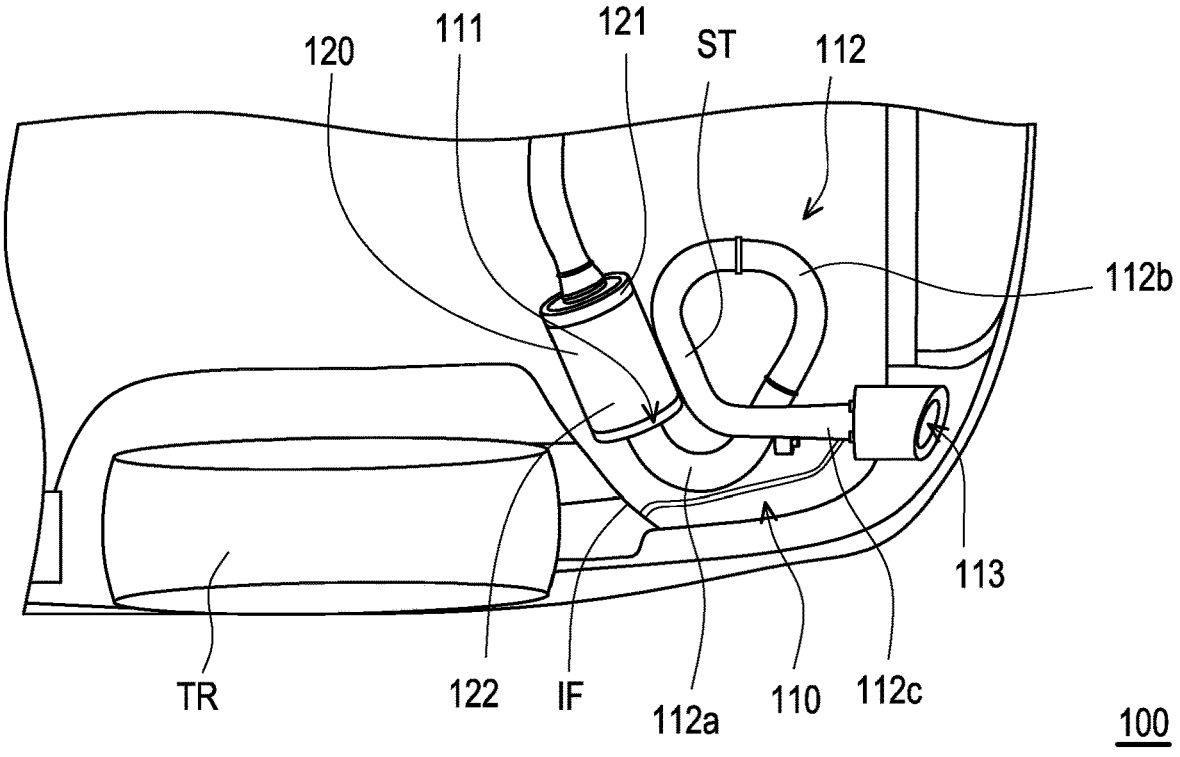
FIG. 2 is a schematic bottom view of the exhaust structure shown in FIG. 1.
Figure 3:
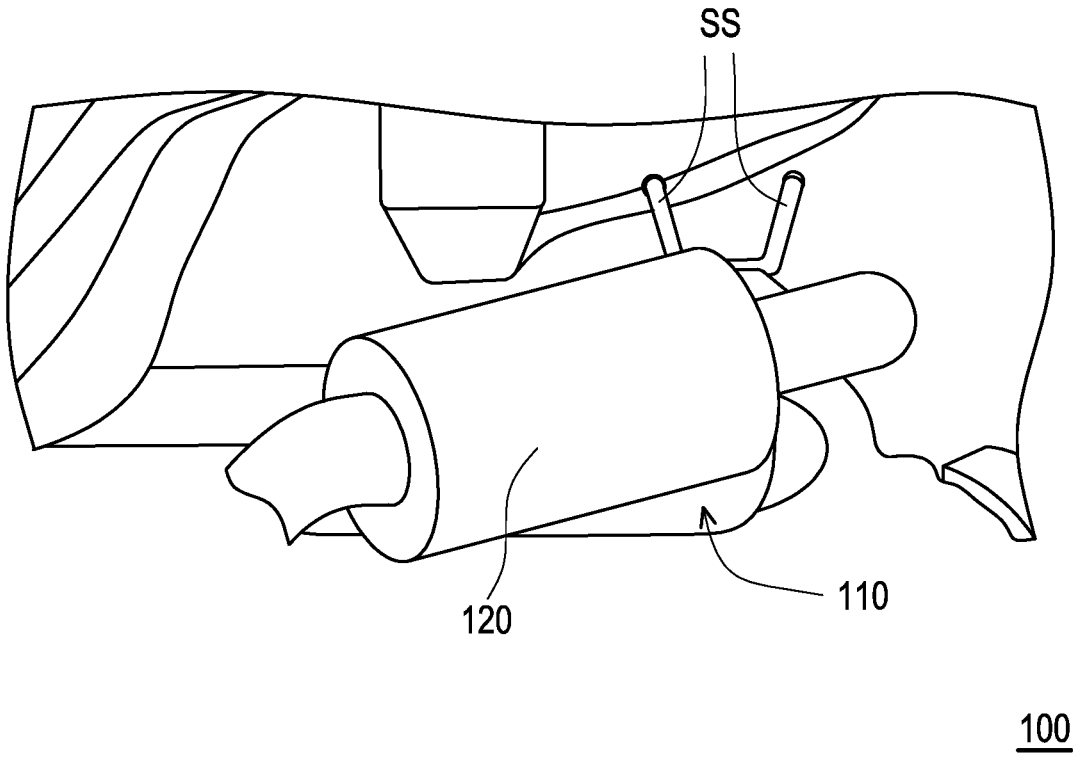
FIG. 3 is a schematic front view of the exhaust structure shown in FIG. 1.
Figure 4:
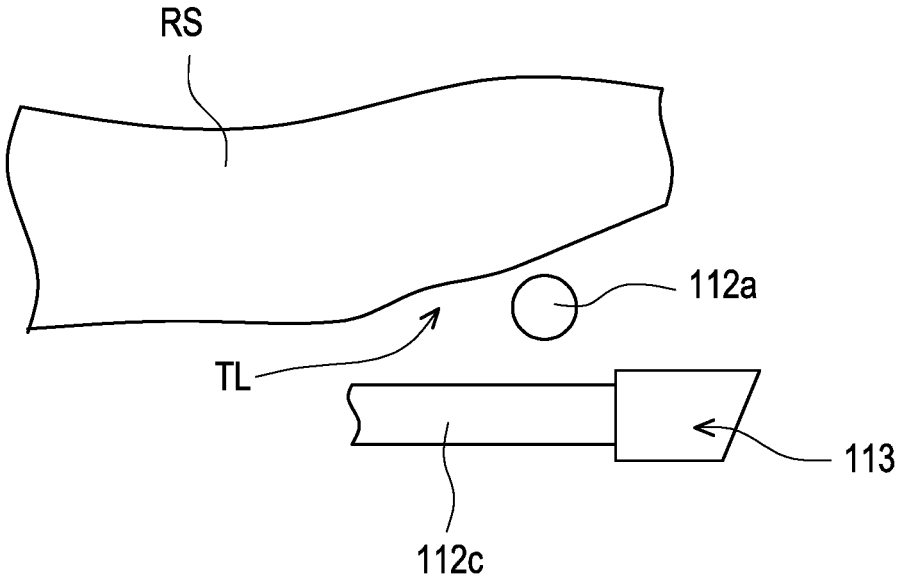
FIG. 4 is a schematic view of a relative relationship between the exhaust structure shown in FIG. 1 and a rear side frame.

FIG. 1 is a schematic side view of an exhaust structure according to an embodiment of a utility model; FIG. 2 is a schematic bottom view of the exhaust structure shown in FIG. 1; FIG. 3 is a schematic front view of the exhaust structure shown in FIG. 1; FIG. 4 is a schematic view of a relative relationship between the exhaust structure shown in FIG. 1 and a rear side frame. In this embodiment, an exhaust structure 100 refers to a part of the structure at the rear of the vehicle for discharging exhaust gas. The specific structure of the exhaust structure 100 will be described below with reference to FIGS. 1 to 4.

Referring to FIGS. 1 to 3, in this embodiment, the exhaust structure 100 includes an exhaust pipe 110 and a muffler 120. The exhaust pipe 110 has an upstream side opening portion 111, a downstream side opening portion 113, and a winding portion 112. The winding portion 112 is formed by winding pipings between the upstream side opening portion 111 and the downstream side opening portion 113, and may be formed in a spiral-like shape. To be more specific, in this embodiment, the winding portion 112 of the exhaust pipe 110 may be formed by combining multiple sections of pipings. For example, as shown in FIG. 2, in this embodiment, the winding portion 112 of the exhaust pipe 110 may include an upper piping 112*a*, a connection piping 112*b*, and a lower piping 112*c*. The upper piping 112*a* is connected to the lower piping 112*c* through the connection piping 112*b*. The winding portion 112 may be formed in a spiral-like shape in a coiled manner by winding the upper piping 112*a*, the connection piping 112*b*, and the lower piping 112*c* inclining and swirling in different directions. On the other hand, the muffler 120 may be connected to the exhaust pipe 110. For example, as shown in FIG. 2, the muffler 120 is connected to the upstream side opening portion 111 of the exhaust pipe 110, and the winding portion 112 overlaps the muffler 120 in a front-rear direction. In this way, as shown in FIG. 3, when viewed from the front to the rear of the vehicle structure, the exhaust pipe 110 may be hidden behind the muffler 120 and be shielded by the muffler 120.

And, as shown in FIG. 1 and FIG. 2, a tire TR is disposed on a front side of the muffler 120 and on an outer side in a vehicle width direction. Further, when splash water W splashed by the tire TR splashes backward, the muffler 120 may block the splash water W splashed to the exhaust pipe 110, and can prevent the splash water W from the front from splashing onto the exhaust pipe 110. In this way, even in the case where exhaust pipe 110 needs to be lengthened, by forming the exhaust pipe 110 on a downstream side of the muffler 120 into a spiral-like shape and hiding it behind the muffler, it is possible to present the splash water W from the front from splashing on the exhaust pipe 110 without adding an additional water cover, and cost and weight can be reduced.

Further, as shown in FIG. 1, in this embodiment, the winding portion 112 of the exhaust pipe 110 is configured to overlap itself in a vertical direction. In this way, by having the winding portion 112 of the exhaust pipe 110 overlap itself in the vertical direction, the space required to configure the winding portion 112 may be minimized, and it is easier for the exhaust pipe 110 to be shielded by the muffler 120.

On the other hand, as shown in FIG. 1, in this embodiment, a suspension point SR is disposed at a portion where the winding portion 112 of the exhaust pipe 110 overlaps itself in the vertical direction. At the suspension point SR, the upper piping 112*a* of the winding portion 112 of the exhaust pipe 110 is connected to a vehicle body through a suspension structure SS. Furthermore, the upper piping 112*a* of the winding portion 112 of the exhaust pipe 110 may be further fixed, such that the vibration of the exhaust pipe 110 during traveling can be suppressed. Compared with the case where there is no suspension point, the gap between each section of the pipings of the exhaust pipe 110 may be shortened. In this way, by disposing the suspension point at the overlapping part of the winding portion 112 of the exhaust pipe 110, the gap between each section of the pipings of the exhaust pipe 110 may be minimized, and the exhaust pipe 110 can be more easily shielded by the muffler 120.

Furthermore, as shown in FIG. 2, in this embodiment, an upstream portion 121 of the muffler 120 is disposed at a position further forward than a downstream portion 122. In other words, as shown in FIG. 2, the muffler 120 is inclined toward the tire TR, and may more easily block the splash water W splashed from the tire TR to the exhaust pipe 110. Further, a straight portion ST constituting a part of the pipings of the winding portion 112 of the exhaust pipe 110 is arranged in parallel with the muffler 120. In this way, by arranging the straight portion ST in parallel with the muffler 120, most of the components of the exhaust pipe 110 may be brought close to the muffler 120 as much as possible, thereby further reducing the probability of the exhaust pipe 110 being subjected to the splash water W splashed by the tire TR. Furthermore, as shown in FIG. 2, an inner fender IF is further provided in front of the muffler 120, such that the splash water W splashed from the tire TR toward the muffler 120 and the exhaust pipe 110 can be further reduced.

Moreover, in this embodiment, the exhaust structure 100 is located at the rear of the vehicle, and as shown in FIG. 4, a rear side frame RS is disposed above the winding portion 112. Furthermore, as shown in FIG. 4, in this embodiment, a rear end of the rear side frame RS is provided with an inclined portion TL extending upward, and the upper piping 112*a* of the winding portion 112 is disposed below the inclined portion TL. In this way, by arranging the upper piping 112*a* of the winding portion 112 below the inclined portion TL, even if the pipings in the winding portion 112 overlap in the vertical direction, sufficient space for disposing the exhaust structure 100 in the vertical direction can still be ensured.

In summary, according to the exhaust structure of the utility model, by forming a winding portion by winding the pipings of the exhaust pipe at the downstream side of the muffler, the exhaust pipe may be hidden behind the muffler when viewed from the front to the rear of the vehicle structure, and can thereby be shielded by the muffler. In this way, splash water from the front can be prevented from splashing onto the exhaust pipe without adding an extra water cover, and cost and weight can be reduced.

In an embodiment of the utility model, the winding portion of the exhaust pipe is configured to overlap itself in a vertical direction.

In an embodiment of the utility model, a tire is disposed on a front side of the muffler and on an outer side in a vehicle width direction, and an upstream portion of the muffler is disposed at a position further forward than a downstream portion. A straight portion constituting a part of the winding portion of the exhaust pipe is arranged in parallel with the muffler.

In an embodiment of the utility model, a suspension point is disposed at a portion where the winding portion of the exhaust pipe overlaps itself in a vertical direction.

In an embodiment of the utility model, a rear side frame is disposed above the winding portion, a rear end of the rear side frame is provided with an inclined portion extending upward, and an upper piping of the winding portion is disposed below the inclined portion.

In an embodiment of the utility model, an inner fender is further provided in front of the muffler.

Based on the above, according to the exhaust structure of the utility model, by forming a winding portion by winding the pipings of the exhaust pipe at the downstream side of the muffler, the exhaust pipe may be hidden behind the muffler when viewed from the front structure to the rear of the vehicle, and can thereby be shielded by the muffler. In this way, splash water from the front can be prevented from splashing onto the exhaust pipe without adding an extra water cover, and cost and weight can be reduced.

Finally, it should be noted that: the above embodiments are only used to illustrate the technical scheme of the utility model, but not to limit it; although the utility model has been described in detail with reference to the foregoing embodiments, those of ordinary skill in the art should understand that: it is still possible to modify the technical solutions described in the foregoing embodiments, or to perform equivalent replacements to some or all of the technical features; however, these modifications or substitutions do not make the essence of the corresponding technical solutions deviate from the scope of the technical solutions of the embodiments of the utility model.

What is claimed is:

1. An exhaust structure for a vehicle, the exhaust structure comprising:

a muffler; and an exhaust pipe connected to the muffler, the exhaust pipe including an upstream side opening portion, a downstream side opening portion, and a winding portion formed by winding pipings between the upstream side opening portion and the downstream side opening portion, wherein the exhaust pipe is connected to the muffler via the upstream side opening portion, and wherein the winding portion is arranged behind the muffler in a front-rear direction of the vehicle.

2. The exhaust structure according to claim 1, wherein the winding portion is configured to overlap itself in a vertical direction of the vehicle.

3. The exhaust structure according to claim 1, wherein:

a tire of the vehicle is disposed on a front side of the muffler in the front-rear direction, and on an outer side of the muffler in a vehicle width direction, an upstream portion of the muffler is disposed at a position further forward in the front-rear direction than a downstream portion of the muffler, and the winding portion includes a straight portion extending parallel to the muffler.

4. The exhaust structure according to claim 1, wherein the exhaust pipe further includes a suspension point disposed at a portion where the winding portion overlaps itself in a vertical direction of the vehicle.

5. The exhaust structure according to claim 1, wherein:

a rear side frame of the vehicle is disposed above the winding portion, a rear end of the rear side frame includes an inclined portion inclining upward, and the inclined portion is disposed above an upper piping of the winding portion.

6. The exhaust structure according to claim 1, wherein an inner fender of the vehicle is disposed in front of the muffler in the front-rear direction.

* * * * *